US005169711A

United States Patent [19]

Bhatt et al.

[11] Patent Number: 5,169,711

[45] Date of Patent: Dec. 8, 1992

[54] PAPER MAKERS FORMING FABRIC

[75] Inventors: Girish M. Bhatt, South Burlington, Vt.; Dale B. Johnson, Ottawa, Canada

[73] Assignee: JWI Ltd., Kanata, Canada

[21] Appl. No.: 642,445

[22] Filed: Jan. 17, 1991

Related U.S. Application Data

[63] Continuation-in-part of Ser. No. 228,447, Aug. 5, 1988, abandoned, and a continuation-in-part of Ser. No. 324,614, Mar. 17, 1989, abandoned.

[51] Int. Cl.[5] ..... B32B 7/00

[52] U.S. Cl. ..... 428/257; 428/258; 428/259; 112/348; 139/383 A

[58] Field of Search ..... 428/257, 258, 259, 224, 428/373; 525/440, 460, 454; 162/DIG. 1, 348; 139/383 A

[56] References Cited

U.S. PATENT DOCUMENTS

| | | | |
|---|---|---|---|
| 3,448,171 | 6/1969 | Damusis | 523/440 |
| 3,761,348 | 9/1973 | Chamberlin | 525/440 |
| 3,987,141 | 10/1976 | Martin | 428/373 |
| 4,071,050 | 1/1978 | Codorniu | 139/383 R |
| 4,129,611 | 12/1978 | Heiss | 525/440 |
| 4,279,801 | 7/1981 | Kramer et al. | 525/440 |
| 4,533,594 | 8/1985 | Buchanan | 428/257 |
| 4,636,426 | 1/1987 | Fleisher | 428/257 |
| 4,663,221 | 5/1987 | Mukimura et al. | 428/373 |

FOREIGN PATENT DOCUMENTS

| | | |
|---|---|---|
| 245851 | 11/1987 | European Pat. Off. . |
| 8301253 | 4/1983 | World Int. Prop. O. . |
| 8704198 | 7/1987 | World Int. Prop. O. . |

*Primary Examiner*—Patrick J. Ryan
*Assistant Examiner*—N. Edwards
*Attorney, Agent, or Firm*—Robert A. Wilkes; Robert G. Hendry

[57] ABSTRACT

This invention discloses a paper-maker's forming fabric wherein some of the yarns are melt-extruded monofilaments, that are a blend of 60 to 90% by weight of a polyethylene terephthalate, together with 40 to 10% by weight of a thermoplastic polyurethane, which may be an ester or ether-based type, Additionally, it is contemplated that the blend may contain up to 5% by weight of a hydrolysis stabilizer. The high abrasion resistance of these blended monofilaments makes them particularly advantageous for use in replacing the nylon-6 and nylon-66 monofilaments currently used in paper machine forming fabrics.

42 Claims, No Drawings

PAPER MAKERS FORMING FABRIC

RELATED APPLICATION

This application is a continuation-in-part of Ser. No. 07/228,447, filed Aug. 5, 1988 is now abandoned, and of Ser. No. 07/324,614, filed Mar. 17, 1989 is now abandoned.

This invention relates to a paper maker's forming fabric made from synthetic plastic fibers.

In a papermaking machine, a continuous sheet of paper or paper-like material is formed by flowing a water-based slurry of cellulosic fibers onto a travelling continuous woven belt. As the slurry travels on the continuous belt, also known as a forming fabric or forming wire, it is transformed into a wet paper web which is largely self supporting, by removing from it much of the water in the initial slurry. A typical slurry as delivered to the moving forming fabric can contain as little as 0.5% by weight of cellulosic fibers, can range in temperature from about 30° C. to about 85° C., and typically has a pH of from 4 to 9. The wet paper web leaving the forming fabric to pass to the press and dryer sections can still contain 80% water by weight.

After leaving the wet end or forming section over a couch roll, the still-wet web is transferred to a press section where a major proportion of the remaining water is removed, by passing it through a series of pressure nips in sequence. On leaving the press section the web passes to a dryer section, which is heated for final drying. The dried web can then be calendered, to smooth the surface, and is finally collected on a reel.

As the wet slurry travels along on the forming fabric, water removal is enhanced by the uses of hydrofoils, by table rolls, and by suction boxes.

This invention is directly concerned with the wet end or forming section of a papermaking machine, and thus is concerned with papermaking fabrics known as "forming fabrics". These fabrics are used to screen a moisture laden mass of cellulose fibers during the initial stage of water removal to transform it into a wet paper web.

In the original Fourdrinier papermaking machines, the forming fabric comprised a structure woven from metal wire, as a result of which these fabrics came to be known as fourdrinier wires. The preferred metal for these wires was phosphor-bronze. These fourdrinier wires were used in all kinds of papermaking machines, and for all qualities of paper. Whilst effective, these wires were not without disadvantages, especially as regards their abrasion resistance capabilities when the cellulose fiber slurry also contained abrasive fillers such as silica and calcium carbonate.

Of recent times, these wire fabrics have been replaced with fabrics based on synthetic plastic fibers, which commonly are monofilaments. Since the ultimate basis of good quality paper lies in the forming fabric itself, the structure and properties of the forming fabric are of vital importance. The major advantage offered by the fabrics based on synthetic plastic monofilaments over the phosphor-bronze wire fabrics is an improved abrasion resistance, which has led to an average improvement in fabric life of over four times that of the wire fabrics. But these fabrics are still prone to abrasion by the same sorts of fillers as caused problems with the older phosphor-bronze wires. For a paper machine forming fabric to be successful, it must desirably possess the following characteristics:

(i) it must be resistant to abrasion both by rubbing contact with machine parts, and by contact with solids in the cellulose fiber-water slurry;

(ii) it must be structurally stable in the plane of the fabric, in order to be able to cope with the stresses imposed on it in use;

(iii) it must resist any dimensional changes in the plane of the fabric due to moisture absorption over a wide range of moisture contents, since when the machine is running it will be fully wet, and when the machine is stopped for any length of time it will dry out;

(iv) it must resist stretching under the tension imposed by the powered rolls which drive the fabric in a paper making machine;

(v) it must be resistant to degradation by the various materials present both in the cellulose fiber-water slurry, and in materials used to clean the forming fabric, at the prevailing temperatures of use.

No known fabric, not even the long-used phosphor-bronze fourdrinier wires, exhibits perfectly all of these characteristics: for example, as noted above, the phosphor-bronze wires do not resist abrasion as much as is desirable. Not even the available synthetic plastic monofilaments will provide fabrics meeting all of these requirements to the sort of level that a papermaker desires. The synthetic polymers which provide the currently most acceptable monofilaments used in making forming fabrics are polyester, more particularly polyethylene terephthalate, and polyamide, particularly nylon-6(polycaprolactam) and nylon-66(poly-hexamethyleneadipamide). These monofilaments have been mixed with others, such as polyethylene and polyesters based on polybutylene terephthalate, but still such fabrics are far from perfect. The major difficulties essentially are two:

(a) whilst polyethylene terephthalate shows more than adequate chemical and dimensional stability and also is amenable to weaving, having good crimpability, and exhibiting good heat-set behaviour, its abrasion resistance leaves something to be desired, especially with the higher speed modern machines.

(b) whilst nylon-6 and nylon-66 show adequate abrasion resistance, they have serious deficiencies for weaving as they have very poor crimpability and inadequate heat-set behaviour, and they possess neither adequate dimensional stability in the moisture range found in the paper making environment, nor adequate resistance to some of the materials used in cleaning forming fabrics.

The inherent dimensional instability of nylon-6 and nylon-66 in the range of moisture contents found in the paper-making environment, running from fully wet to dry, imposes a restriction on the ratio of nylon monofilaments to polyethylene terephthalate monofilaments which may be used. This is cited as 50% in both U.S. Pat. Nos. 4,529,013 and 4,289,173; West German OS 2,502,466 similarly gives a figure of 50%, and additionally suggests that the nylon filaments should have at least 4% (the maximum recommended is 25%) larger diameter than the polyester monofilaments. Attempts to circumvent this difficulty by improving the abrasion resistance of polyester monofilaments, while still retaining their superior dimensional stability when compared to nylon, for example as in European Published Application 158,710, have not been completely successful. Similarly, improving the abrasion resistance of the nylon monofilament, for example as disclosed in Canadian patent 1,235,249, does not permit one to overcome this restriction on nylon monofilament content as it does nothing to alleviate the known nylon dimensional instability. An alternative solution which is concerned with the poor crimpability of nylon is proposed in U.S. Pat. No. 4,709,732; however, this involves an increase in fabric weave complexity, and, as it does not address the dimensional instability, does not permit the nylon content to be increased.

Thus a forming fabric containing both a nylon and a polyester provides an acceptable compromise, provided the amount of nylon used is limited. Such fabrics also appear to be resistant to the pH which can be expected in use, which may range from about 4 to a value in the 8-9 range. Polyester fibers do not degrade unduly under these conditions, even under the ranges of temperature extending up to about 85° C. encountered in modern paper making machines.

This invention seeks to provide a solution to the problems associated with the use of nylon, by making available an alternative papermakers forming fabric including monofilaments based on a polymer blend which has the weaving and heat setting characteristics of polyethylene terephthalate. This fabric also at least approaches the abrasion resistance capabilities of the common nylon-containing fabrics. For the remainder of the forming fabric it is preferred to use monofilaments of polyethylene terephthalate, but this invention is not limited to the use of this polymer for the remainder of the fabric, as other yarns or monofilaments could be used. Additionally, whilst in the following description this invention is discussed by way of reference to monofilaments as being the woven fibers, it is not so limited, and is applicable to forming fabrics woven from both yarns and monofilaments. It is preferred that the yarn used be a monofilament.

Thus in its broadest aspect this invention provides a forming fabric for use in a papermaking machine woven from:

(a) at least one set of yarns woven in a first direction of the fabric, and (b) at least one set of yarns woven in a second direction of the fabric, substantially perpendicular to the first direction, which second direction yarns include monofilaments formed from a blend consisting essentially of from more than 60% to 90% by weight of polyethylene terephthalate polyester, from less than 40% to 10% by weight of a thermoplastic polyurethane, and from zero up to about 5% of a hydrolysis stabilizer, wherein:

(i) the polyester has an intrinsic viscosity of between 0.50 and 1.20 when measured in a solvent comprising a 60:40 parts by weight mixture of phenol and 1,1,2,2-tetrachloroethane at a temperature of 30° C.;

(ii) the polyester has a water content of at most 0.007%;

(iii) the polyurethane is either an ether-based or an ester-based thermoplastic polyurethane polymer;

(iv) the polyurethane has a water content of less than 0.01% water; and (v) the polyurethane has a Durometer Type A hardness of no more than about 95 or a Durometer Type D hardness of no more than about 75.

In this fabric in a preferred embodiment the yarns used in both the first and the second direction are monofilaments, and it is also preferred that the yarns used in the first direction, together with the remainder of the yarns in the second direction, are polyethylene terephthalate.

Utilization of the new monofilament of this invention in its broadest aspect is thus independent of the form of weave used. It encompasses those fabric commonly known as single layer, double layer or duplex, and composite. Descriptions of these generic forming fabric types are provided, amongst other places, in U.S. Pat. Nos. 3,858,623 and 4,071,050 and in Canadian Patent 1,115,177, respectively.

Preferably, the percentage range by weight of thermoplastic polyurethane is above about 15%; more preferably 25% to about 35%; and most preferably the amount of thermoplastic polyurethane is about 30%.

In a further broad aspect this invention provides a forming fabric for use in a papermaking machine wherein the minor proportion of the yarns making up the face of the forming fabric onto which the cellulose fiber pulp slurry is laid are monofilaments of a blend of polyethylene terephthalate with a thermoplastic polyurethane as defined above, and wherein the major proportion of the yarns making up the machine side of the forming fabric are monofilaments of a blend of polyethylene terephthalate with a thermoplastic polyurethane as defined above.

Preferably, in this fabric, the major proportion of the yarns in the face onto which the slurry is laid, and the minor proportion of the yarns making up the machine side of the fabric, are polyethylene terephthalate. Optionally, this fabric may also contain from 0.3 to 5% by weight of a hydrolysis stabilizer.

In a preferred embodiment of this fabric, one set of yarns will generally be intended to provide abrasion resistance, and will comprise the blend of polyethylene terephthalate and thermoplastic yarns.

In the following description, it is to be understood that the term "machine direction " means a direction substantially parallel to the direction in which the forming fabric moves in the paper machine. Similarly, the term "cross-machine direction " means a direction substantially at a right angle to the "machine direction", and in the plane of the fabric. For a forming fabric which is not woven as a continuous loop but rather as an ordinary length of fabric (which is later joined to provide a continuous loop), "machine direction" corresponds to the warp threads, and "cross-machine direction" to the weft threads.

The fabrics of this invention are thus comprised of two different yarns, preferably one of which is a polyester monofilament, and the other of which is a monofilament of a polyester-thermoplastic polyurethane blend. Quite surprisingly it has been found that blends containing from 10% to at most 40% of polyurethane provide a monofilament which has abrasion resistance characteristics approaching those of a nylon monofilament, but without the other attendant problems of such a nylon monofilament deriving from its lack of permanent crimpability. Indeed certain polyester-thermoplastic polyurethane blends exhibit better crimpability and heat set behaviour than those of the polyester when that polyester is used without any thermoplastic polyurethane in the monofilament. This property has a direct bearing on the weaving behaviour of these monofilaments, and is wholly unexpected. The use of this blend monofilament also allows further simplification of the weaving process, since it permits the elimination of the nylon monofilaments often used in the cross-machine direction to provide adequate abrasion resistance properties to the machine side of the fabric. In order to balance the known dimensional instability of the nylon in the presence of water, at best it can comprise alternate yarns in the weave; thus, a cross machine yarns mix is not needed with the monofilaments of this invention as the polyester-thermoplastic polyurethane blend monofilaments can be used alone as the only cross-machine yarns. This is of particular interest in complex multi-layer fabrics, wherein the polyester-thermoplastic polyurethane blend monofilament need only be used as the cross machine yarn in the machine-side of the fabric, as this is the surface exposed to most of the abrasion.

For the blend monofilament, there are some necessary criteria which the polyester component must meet not only to provide a material which can be melt extruded into suitable monofilaments, but also to provide a polymer blend which has adequate properties. In addition to the standard requirements of purity, lack of "dirt", and particularly lack of water (the polyester should be relatively anhydrous with at most 0.007% of water) the polyester should also have a molecular weight similar to that of resins commonly used to provide warp and weft yarns. Thus the polymer should have an intrinsic viscosity of between 0.50 and 1.20, when measured in accordance with the procedure set forth below. Preferably, the intrinsic viscosity is in the range of from 0.65 to 1.05. Polyethylene terephthalate grades available under the following designations (which include trade marks) have this property:

Dupont "MERGE 1934" (a product of Du Pont sold under this description)

ARNITE A06-300 (a trade mark of Akzo)

VITUF 9504C (a trade mark of Goodyear)

TENITE 10388 (a trade mark of Eastman)

As a guide, only, it is believed that these preferred viscosities correspond to number average molecular weights in the range of from about $1.5\times10^4$ to about $5.2\times10^4$.

The intrinsic viscosity, when given herein, is measured on a solution of the polyester in a mixed solvent comprising a 60:40 part by weight mixture of phenol and (1,1,2,2)-tetrachloroethane. The viscosity measurements are carried out at 30° C.

Turning now to the thermoplastic polyurethane part of the blend, it is again necessary that the material used be essentially anhydrous (less than 0.01% water), free from impurities as far as possible, and also free of "dirt", so that it can be processed by normal melt extrusion techniques into a monofilament. Generally, thermoplastic polyurethane are of two types; those derived from polyesters, and those derived from polyethers. For the purposes of this invention it has been found that the polyester variety is more effective, and hence is preferred.

Preferably, the thermoplastic polyurethane is a relatively soft material, the softness being measured in accordance with the standard procedure set forth in ASTM Method D.2240. The hardness should be no greater than 95 when measured with a Type A durometer, or no greater than 75 when measured with a Type D durometer.

Thermoplastic polyurethane grades available under the following designations (which include trade marks) have been found to be suitable for preparing the blended polymer monofilaments of this invention:

| Polyurethane Designation | Type | Durometer Hardness | Type |
|---|---|---|---|
| TEXIN 445D (1) | Ester | 45 | D |
| ELASTOLLAN C95 (2) | Ester | 94–98 | A |
| | | 43–49 | D |
| PELLETHANE 2102-80AE (3) | Ester | 80 | A |
| TEXIN 990A (1) | Ether | 90 | A |
| PELETHANE 2103-80A (3) | Ether | 80 | A |

(1) a Trade Make of Mobay$_{B}$1
(2) a Trade Make of BASF$_{B}$2

In the preceding discussion, mainly for the sake of simplicity, the percentages given total to 100%. Generally speaking, the only other addition is a small amount, less than 0.5% by weight maximum, of a dye or pigment, such as $TiO_2$, to give the fiber a desired appearance. Under certain conditions a hydrolysis stabilizer is necessary. If the paper making machine is being operated at below temperatures of about 43° to 48° C., then hydrolysis of the blended monofilaments of this invention is not a dominant consideration. Many paper making machines operate at higher temperatures than this, up to about 85° C. At this order of temperature, hydrolysis stabilizers are necessary, as otherwise it appears that the blended fibers degrade more rapidly than is desirable. As will be shown below, it appears that it is the thermoplastic polyurethane which is being degraded, since tests have shown that although the tensile strength is only marginally being affected, the abrasion resistance decreases significantly.

The amount of stabilizer used can thus range from none at all, up to a maximum of about 5% of the total weight, beyond which no further improvement appears to be observed. Where a stabilizer is used, it seems that below about 0.3% the amount of protection given is minimal. We therefore prefer to use the stabilizer in a range of from about 0.3% to 5.0%, with a preferred range being from about 0.7% to about 3%. The stabilizer is conveniently incorporated into the blend by way of a "masterbatch" made up in either the thermoplastic polyurethane or the polyester. Commercially available stabilizers of the latter type which have been found to be successful are:

STABAXOL KE7646 (a trade mark of Rhein Chemie and is a concentrate of STABAXOL P100 in high intrinsic viscosity (0.95) PET (15% STABAXOL P100/85% high intrinsic viscosity PET). Master batch manufactured and sold by Rhein-Chemie, a division of Mobay Corp.)

STABAXOL P100 (a trade mark of Rhein Chemie and is known by the chemical name triisopropylbenzene polycarbodiimide, identified by Chemical Abstracts Registry Number 29117-01-9, and has the following chemical formula: $(C_{16}H_{22}N_2)_n$)

HYTREL 10MS (a trade mark of DuPont and is a concentrate of polycarbodiimide (PCD), a hydrolysis stabilizer, in a 40 D grade of HYTREL polyester elastomer. It contains 20% PCD by weight. HYTREL 10 MS is intended to be blended with unmodified HYTREL at a let-down ratio of 1:9 (i.e. to yield a final level of 2% PCD) in order to improve the performance of HYTREL in hot, wet environments. HYTREL is a polyether-ester block copolymer having "soft" and "hard" segments. The "soft" segments are multibutyleneoxyterephthalate blocks, while the "hard" segments contain butyleneterephthalate or tetramethyleneterephthalate units.).

It is also comtemplated that the monofilaments can be surface coated as produced, for example with a combined antistatic agent and lubricant, to facilitate handling and weaving.

Generally speaking such coatings are removed very quickly when the fabric gets used in a paper making machine.

EXAMPLES

For brevity, in the following Examples the following abbreviations are used. The term PET is used to denote polyethylene terephthalate, and the term TPU is used to denote thermoplastic polyurethane. Where necessary, the TPU is identified as being ether-based or ester-based.

In the following Examples, the PET used was a Du Pont product, sold under the description "MERGE 1934". Generally, this material was dried before use, and also post-condensed in the solid state to ensure that the intrinsic viscosity is within the desired range. Similarly, the TPU material was also dried before use. In all cases, the nylon was nylon 66.

These Examples also utilize monofilaments prepared from the specified polymers. Where relevant, the dimensions of these monofilaments are given. Generally, the monofilaments used in forming fabrics will have a size within the range of from about 0.1 mm to about 0.9 mm, and most often in the range of from about 0.127 mm to about 0.4 mm. It should also be noted that the monofilament is not necessarily of circular cross section, and particularly may be in the form of a rectangle or ribbon.

A. Monofilament Abrasion

To determine their abrasion resistance, lengths of monofilaments strands are initially weighed and then wound in a single layer around one end of a polyethylene rod. A polyester control monofilament is wound around the other end. The rod is then mounted on the lower end of a vertical shaft, at right angles to it, so as to immerse the two windings in a slurry of 57% by weight of No. 24 grit sand in water. The shaft is rotated by a motor driven above the tank containing the slurry. After a predetermined time, the strands are removed from the slurry, unwound, dried, and weighed. The abrasion resistance is determined by calculating the percentage weight loss. The time and shaft rotation speed are chosen to give measurable results. The abrasion resistance of degraded samples is determined in the same manner after the coils of monofilament have been immersed in solutions of controlled pH and temperature for varying lengths of time.

The following results were obtained for PET-TPU blends of varying TPU concentrations:

| Example | Composition | % Weight Loss |
|---|---|---|
| A1 | 100% PET Control | 3.2 |
| A2 | 95% PET + 5% TPU | 3.4 |
| A3 | 85% PET + 15% TPU | 3.1 |
| A4 | 75% PET + 25% TPU | 2.4 |
| A5 | 65% PET + 35% TPU | 1.8 |
| A6 | 55% PET + 45% TPU | 1.1 |

This data shows that the abrasion resistance of monofilaments made from blends of PET and TPU is slightly better than PET when the TPU concentration is 15%, and becomes increasingly better as more TPU is added, up to a level of 45%. At this concentration, however, the monofilament becomes difficult to control during extrusion and becomes extremely soft, making it unsuitable for weaving and heat setting. The TPU used in these experiments was TEXIN 445D.

The effect of stabilizer on improving the degradation resistance of the blended monofilaments is illustrated by the following results for a pH 4.0 solution:

| Example | Composition | Exposure | % Weight Loss |
|---|---|---|---|
| A7 | 64% PET + 36% TPU | 71° C. for 21 days | 2.3 |
| A8 | 64% PET + 36% TPU | 88° C. for 7 days | 2.3 |
| A9 | 64% PET + 36% TPU | 100° C. for 3 days | 2.7 |
| A10 | 62% PET + 37% TPU + 1% Stabilizer | 71° C. for 21 days | 1.2 |
| A11 | 62% PET + 37% TPU + 1% Stabilizer | 88° C. for 7 days | 1.2 |
| A12 | 62% PET + 37% TPU + 1% Stabilizer | 100° C. for 3 days | 1.4 |

This data shows that the addition of stabilizer to the blend of PET-TPU results in a significant improvement in degradation resistance at all test temperatures. The stabilizer in this case was STABAXOL KE7646 and the TPU was TEXIN 445D.

The effect of stabilizer concentration is shown in the following table:

| Example | Composition | Exposure | % Weight Loss |
|---|---|---|---|
| A13 | 66% PET + 34% TPU | 100° C. for 3 days | 2.5 |
| A14 | 73.2% PET + 26% TPU + .8% Stabilizer | 100° C. for 3 days | 1.9 |
| A15 | 71.8% PET + 26% TPU + 2.2% Stabilizer | 100° C. for 3 days | 1.9 |

Both stabilized blends have greatly improved degradation resistance but the higher concentration of stabilizer does not give any further improvement. In these examples, the TPU was PELLETHANE 80AE and the stabilizer, STABAXOL KE7646.

In another test the effect of the stabilizer on the abrasion resistance of an unhydrolysed blend of 65% PET and about 35% TPU was investigated. The results are given in the following table:

| Example | Strand Description | % Weight Loss |
|---|---|---|
| A19 | Polyester | 2.2 |
| A20 | 64% PET + 36% TPU | 1.2 |
| A21 | 62% PET + 37% TPU + 1% Stabilizer | 1.1 |

This data shows that the addition of stabilizer does not have any detrimental effect on abrasion resistance. In this experiment the TPU was TEXIN 445D and the stabilizer, STABAXOL KE7646. The polyester used in all examples, A1 to A19, was DuPont MERGE 1934, post-condensed in the solid state.

B. Fabric Abrasion

To measure the abrasion resistance of forming fabrics, a fabric sample is held under tension against the outer surface of a drum comprised of ceramic segments rotating in a horizontal plane. A jet of water is continuously applied to the entrance nip of the fabric on the drum so as to keep the fabric and ceramic surface wet.

The thickness of the fabric is measured at the beginning of the test and thereafter at predetermined times after exposure to the rotating ceramic segment surface. The loss of thickness is a measure of abrasion resistance.

A series of double layer fabric samples were woven with warps of 0.16 mm diameter at a mesh count of 59/cm. The bottom, or machine side set of wefts were woven using PET, alternating PET/nylon, and 75% PET/25% TPU blend. In each case the weft count was 51/cm.

All of these samples were woven with a paper side weft diameter of 0.19 mm and a machine side weft diameter of 0.30 mm. All of the samples were heat set identically. The results of abrasion tests in which the machine side of the fabric was in contact with the drum are given in the following table.

| | | Thickness Loss in millimeters | | |
|---|---|---|---|---|
| Example | Time in Minutes | PET Control | Alternating PET/Nylon 66 | 75% PET/25% TPU Blend |
| B1 | 30 | .0132 | .0147 | .0124 |
| B2 | 60 | .0165 | .0157 | .0142 |
| B3 | 105 | .0210 | .0180 | .0162 |

This result shows that both the fabric comprised of alternating PET/nylon weft and the fabric comprised of the 75% PET/25% TPU blend weft have much better abrasion resistance than the fabric woven with PET weft. Moreover, the fabric with the PET/TPU weft is more abrasion resistant than the fabric with alternating PET/nylon.

In a second series of tests, the abrasion resistance of fabric samples with blended monofilaments having different concentrations of PET and TPU woven in the bottom layer of a composite fabric was measured. The upper mesh count was 25/cm, the lower mesh count 12.5/cm. The rectangular-section upper and lower warps were 0.11 mm by 0.19 mm, and 0.19 mm by 0.38 mm respectively. The wefts were PET monofilaments, with the upper weft having a diameter of 0.18 mm and the lower weft having a diameter of 0.30 mm. A 0.14 mm PET weft binder strand or tie strand was used in all cases. The bottom layer of the fabric was in contact with the drum.

| Example | Composition | Thickness Loss in Millimeters after 75 Minutes |
|---|---|---|
| B4 | 100% PET Control | .0188 |
| B5 | 84% PET + 16% TPU | .0152 |
| B6 | 75% PET + 25% TPU | .0137 |
| B7 | 65% PET + 35% TPU | .0119 |
| B8 | Alternating PET/Nylon 66 | .0124 |

The TPU used was TEXIN 445D, and the PET was DuPont MERGE 1934, post-condensed in the solid state.

This data supports the findings of strand abrasion tests; namely, that the abrasion resistance of cloth woven with blended PET/PTU weft exhibits superior abrasion resistance to cloth woven with 100% polyester weft, and further that the abrasion resistance improves with increasing concentrations of polyurethane. The 65% PET/35% TPU sample is more abrasion resistant than the alternating PET/nylon-66 sample.

C. Wet to Dry Dimensional Stability

Forming fabrics are often subjected to cycles of drying and wetting. For example, they are delivered dry to the paper mill and become saturated with water shortly after the paper machine is run to make paper. During its life time a forming fabric may be dried out several times at maintenance shut-downs or week-ends. A forming fabric with a large proportion of nylon monofilaments in the cross machine direction will then suffer from changes in width. In cases where the polyester and nylon monofilaments lie in two separate layers, the forming fabric will curl badly at the edges due to the differential expansion or contraction of the two layers. This behaviour limits the use of nylon monofilaments to 50% of the total cross machine direction filaments. In the great majority of forming fabrics it is limited to 25% of the total; that is, 50% of the machine side cross machine direction monofilaments being nylon and the remainder of the machine side monofilaments and all of the paper side monofilaments being PET. At 25% nylon content and the polyester monofilaments substantially prevent the nylon monofilaments, and the entire fabric, from expanding or contracting significantly under conditions of different water content.

The following table shows the length changes occurring in monofilaments made from nylon, polyester, and the blended monofilaments of this invention when subjected to a cycle of wetting (boiling in water) and then drying out. Measurements of length were made at room temperature immediately after the wetting or drying.

| Example | Monofilament Composition | % Length Change Dry to Wet | % Length Change Wet to Dry |
|---|---|---|---|
| C1 | 100% Nylon-66 | −0.74 | +0.64 |
| C2 | 100% PET | −0.07 | +0.07 |
| C3 | 95% PET/5% TPU | −0.07 | +0.04 |
| C4 | 85% PET/15% TPU | −0.10 | +0.10 |
| C5 | 75% PET/25% TPU | −0.03 | +0.03 |
| C6 | 65% PET/35% TPU | −0.07 | +0.04 |
| C7 | 55% PET/45% TPU | −0.43 | +0.23 |

TPU: TEXIN 445D
PET: Dupont "MERGE 1934", post-condensed to an IV of 1.02.

The results clearly show the well-known difference in behaviour between nylon and polyester monofilaments. The results also show that the blended monofilaments of this invention are very stable. At 45% TPU content the blended monofilament begins to suffer from dimensional instability.

D. Crimpability

A commonly used measure of crimpability of the weft strands in forming fabrics is the so-called crimp differential. The warp monofilaments in the final cloth tend to be straighter than the weft monofilaments, which, to a degree, are simply bent over and under the warp monofilaments. The weft monofilaments therefore tend to lie proud of the warp monofilaments, particularly on the machine-side of the fabric. But if the weft is a very stiff monofilament, then it will tend to bend the warp monofilament and thus not lie so proud of the warp. By careful measurement of the cloth thickness, it is possible to determine how far the weft thread is out of the plane of the warp threads. This difference in the warp and weft planes is known as the crimp differential. As the crimpability of the weft monofilament increases, so also does the crimp differential, in any given weave construction.

Examples of the crimp differentials observed in samples of double layer cloth having identical weave construction, warp strands, mesh counts and heatsetting history for different weft strands is given in the table below.

| Example | Weft Strand | Crimp Differential (mm) |
|---|---|---|
| D1 | 0.30 mm PET | .014 |
| D2 | 0.30 mm PET alternating with 0.30 mm nylon | .012 |
| D3 | 0.30 mm 75% PET/ 25% TPU blend | .017 |

This illustrates that PET-TPU monofilaments have very high crimpability compared to polyester, whereas nylon has lower crimpability. The blended PET and TPU are the same as for Example E5, below.

E. Mechanical Stability

The mechanical stability of a forming fabric is assessed by measuring its resistance to stretching and narrowing.

A sample of cloth 25.4 mm long and 50 mm wide is mounted in an Instron (trademark) tensile tester. The load and elongation are recorded as the tension of the sample is increased from zero to 7.16 kg/cm. Stretch resistance is derived by measuring the slope of the load-elongation curve. This defines the elastic modulus of the cloth, which for forming fabrics is typically from about 1,100 to about 2,000 kg/cm.

Narrowing resistance is measured on the same sample, mounted in an Instron, except that the reduction in width is accurately determined as the sample tension is increased from zero to 7.16 kg/cm. A narrowing resistance factor is found by dividing the observed width change, expressed in percent, by the total increase in tension. Typical narrowing resistance factors for forming fabrics are 0.005%/kg/cm to 0.050%/kg/cm.

Thus, optimum mechanical stability is reflected by high values of the elastic modulus and low values of the narrowing resistance factor.

To assess the effect of weft materials on mechanical stability, three samples of a plain weave/plain weave fabric, having rectangular warps of 0.11 by 0.19 mm, threaded at 25/cm in the upper weave, and rectangular warps of 0.19 by 0.38 mm, threaded at 12.5/cm in the bottom weave, were woven. Three different bottom layer wefts were woven at identical mesh counts and the resulting samples were heat-set using identical conditions. The elastic moduli and narrowing resistance factors of the three samples are given in the table below. The data for samples E1 and E2 shows that nylon has an adverse effect on the elastic modulus and narrowing resistance factor of the cloth.

| Example | Description | Heatsetting Tension kg/cm | Elastic Modulus kg/cm | Narrowing Resistance Factors kg/cm |
|---|---|---|---|---|
| E1 | 0.3 mm PET weft | 5.37 | 1238 | .015 |
| E2 | 0.3 mm alternating PET and nylon 66 weft | 5.37 | 1091 | .035 |
| E3 | 0.3 mm alternating PET and nylon 66 weft | 6.26 | 1292 | .032 |

This behaviour of nylon is partially overcome by using higher heatsetting tensions to force the nylon to higher levels of permanent crimp, as example E3 illustrates. Note that the stretch resistance was improved by the higher heat setting tension, but the narrowing resistance factor was relatively unaffected. The monofilaments comprising blends of PET and TPU are inherently more crimpable, and given an improvement in mechanical stability. This is shown by the data in the following table, which compares a fabric sample with 75% PET/25% TPU weft, woven and heat set identically to the samples described above, with sample E1, containing a PET-only weft.

| Example | Description | Heatsetting Tension kg/cm | Elastic Modulus kg/cm | Narrowing Resistance Factors kg/cm |
|---|---|---|---|---|
| E1 | 0.3 mm PET weft | 5.37 | 1,238 | .015 |
| E5 | 0.3 mm PET/TPU weft | 5.37 | 1,408 | .012 |

The PET is Dupont MERGE 1934, post-condensed in the solid state, and the TPU was TEXIN 445D.

F. Chemical Resistance

In a papermaking environment forming fabrics can be subjected to periodic cleaning which often involves harsh acidic conditions. This cleaning with strong acids has a deleterious effect on any nylon monofilaments in the forming fabrics, thus reducing the life of the fabric and negating the enhanced abrasion resistance derived from the presence of nylon in the fabric. Tests were conducted in which coils of nylon, polyester, and various PET/TPU blends were immersed in 30% hydrochloric acid at 25° C. for various times. The nylon completely dissolved after 17 hours exposure, whereas the polyester and PET/TPU blends showed no detrimental effects after 222 hours exposure. This indicates that PET/TPU blends have greatly superior resistance to harsh acid cleaning solutions than nylon.

G. Polyester Molecular Weight

To determine whether the molecular weight of the polyester used in the blends has any effect on the abrasion resistance of the monofilament, two monofilament blends were extruded under identical conditions with the same polyurethane concentration, but with polyesters of different molecular weight, as measured by intrinsic viscosity (I.V.). The abrasion resistance of the monofilaments was then measured in the sand slurry test and the results are given in the following table:

| Example | Strand Description | I.V. | % Weight Loss |
|---|---|---|---|
| G1 | 100% PET Control | 1.02 | 2.8 |
| G2 | 100% PET Control | 0.65 | 3.1 |
| G3 | 75% PET; 25% TPU | 1.02* | 1 9 |
| G4 | 75% PET; 25% TPU | 0.65* | 2.1 |

*this is for the polyester used alone, not for the blends.

From these figures it can be seen that when blended with TPU, the higher molecular weight PET provides a filament with a slightly better abrasion resistance than that of the lower molecular weight PET. Both filaments have significantly better abrasion resistance than the PET control monofilaments. Thus it appears that the molecular weight of the PET is not the critical factor in determining the abrasion resistance of PET-TPU blend monofilaments.

H. Comparison of Ether-Based and Ester-Based TPU

To establish whether ester-based TPU gives any advantages over ether-based TPU from the standpoint of abrasion resistance, a series of blends were extruded under identical conditions, using the same molecular weight PET, having an I.V. of 102. The abrasion resistance of the monofilaments was then measured using the sand slurry test. The results are given in the following table:

| Example | Monofilament Composition | % Weight Loss |
|---|---|---|
| H1 | 100% PET Control | 3.2 |
| H2 | 80% PET + 20% Ether-based TPU | 2.7 |
| H3 | 70% PET + 30% Ether-based TPU | 2.4 |
| H4 | 80% PET + 20% Ester-based TPU | 2.5 |
| H5 | 70% PET + 30% Ester-based TPU | 2.0 |

This data illustrates that for a given TPU concentration, the ester-based TPU gives better abrasion resistance than ether-based TPU. The ester-based TPU used was TEXIN 445D, and the ether-based TPU was TEXIN 990A. The PET was Dupont MERGE 1934, which had been post-condensed in the solid state.

I. Monofilament Extrusion

To produce the monofilaments comprising blends of polyester and polyurethane, the polyester and polyurethane resin beads are first dried, then mechanically mixed and loaded into an extruder hopper, which feeds a single screw extruder. The desired amount of stabilizer, if used, is also added, conveniently as a master batch or concentrate in either the polyester or the polyurethane. The amount of polyester or polyurethane added with the stabilizer is taken into account in determining component quantities. The melting and intimate mixing of the resin mixture takes place as the screw conveys the molten mixture forward through a heated barrel at a temperature of about 275° C. The molten polymer blend is conveyed to a metering pump which forces the mixture through a die to form monofilaments. The extrusion temperature may range from 260° to 285° C., with the range 265° to 275° C. being preferred.

After exiting the die, the monofilaments are quenched in a water bath to form solid filaments. These are drawn at elevated temperatures of up to 100° C. between a set of draw rolls to a draw ratio of from 3.0:1 to 4.5:1, and optionally further drawn at a higher temperature of up to 250° C. to a maximum draw ratio of 6.5:1 and allowed to relax up to about 30% maximum whilst heated in a relaxing stage. The finished cooled monofilaments are then wound onto spools.

The monofilament of the present invention was produced according to the foregoing process. A typical example is as follows.

Examples I1 and I2

A uniform mixture of pellets of 65% by weight of Dupont polyester resin MERGE 1934, post-condensed in the solid state, to an I.V. of 1.05, and 35% by weight of TEXIN 445D thermoplastic polyurethane resin, having a Durometer hardness of 45 on the D scale, were placed in the extruder hopper and extruded. The extrusion conditions, which are not to be considered limiting, were:

First Heater Zone Temperature: 260° C.
Second Heater Zone Temperature: 265° C.
Third Heater Zone Temperature: 265° C.
Extruder Die Temperature: 265° C.

The extruder die had eight 0.80 mm holes. The final monofilament size was 0.30 mm. The monofilament was quenched in a water bath at a temperature of 66° C., positioned 2.0 cm under the die. The quenched monofilament was drawn in a hot air oven at a temperature of 74° C. with a draw ratio of 3.36, drawn further in a hot air oven at a temperature of 230° C. to a total draw ratio of 5.0 and allowed to relax 25% at a temperature of 280° C. The finished monofilament was then taken up on spools for testing. In a similar second run, a similar monofilament was prepared using 73% polyester, 26% polyurethane, and 1% stabilizer.

For comparative purposes, the polyester resin was extruded into a monofilament using the same extrusion conditions described for the polyester-polyurethane blend. The physical properties of the three materials were tested and the results are given below.

| | Polyester | I1 65% PET-35% TPU | I2 73% PET - 26% TPU - 1% Stabilizer |
|---|---|---|---|
| Tensile Strength kg/meter$^2$ | $5.55 \times 10^9$ | $2.88 \times 10^9$ | $2.83 \times 10^9$ |
| Tensile Elongation | 55.7% | 73.2% | 62.0 |
| Elastic Modulus kg/meter$^2$ | $0.70 \times 10^9$ | $0.40 \times 10^9$ | $0.44 \times 10^9$ |
| Shrinkage at 220° C. | 10.5% | 7.9% | 13.6 |
| Abrasion Resistance* | 3.2 | 1.8 | 1.8 |

*As measured by weight loss, according to the method previously described, %.

What is claimed is:

1. A forming fabric for use in a papermaking machine, which is woven from:

(a) at least one set of yarns woven in a first direction of the fabric, and (b) at least one set of yarns woven in a second direction of the fabric, substantially perpendicular to the first direction, which second direction yarns comprising monofilaments formed from a blend consisting essentially of from more than 60% to 90% by weight of polyethylene terephthalate polyester, from less than 40% to 10% by weight of a thermoplastic polyurethane, and from zero up to about 5% of a hydrolysis stabilizer, wherein:

(i) the polyester has an intrinsic viscosity of between 0.50 and 1.20 when measured in a solvent comprising a 60:40 parts by weight mixture of phenol and 1,1,2,2-tetrachloroethane at a temperature of 30° C.;

(ii) the polyurethane is either an ether-based or an ester-based thermoplastic polyurethane polymer; and (iii) the polyurethane has a Durometer Type A hardness of no more than about 95 or a Durometer Type D hardness of no more than about 75.

2. A fabric according to claim 1 wherein the at least one set of yarns woven in a first direction of the fabric comprise polyethylene terephthalate monofilaments.

3. A fabric according to claim 2 wherein the at least one set of yarns woven in a second direction of the fabric comprises a mixture of monofilaments of polyethylene terephthalate and of monofilaments of the blend of polyethylene terephthalate and thermoplastic polyurethane.

4. A fabric according to claim 1 wherein the polyester intrinsic viscosity is in the range of from 0.95 to 1.20.

5. A fabric according to claim 1 wherein in the blended monofilament the polyurethane is an ester-based thermoplastic polyurethane polymer.

6. A fabric according to claim 1 wherein in the blended monofilament the polyurethane is an ether-based thermoplastic polyurethane polymer.

7. A fabric according to claim 1 wherein the blended monofilament contains at least 20% by weight of polyurethane.

8. A fabric according to claim 1 wherein the blended monofilament contains from about 25% to about 35% by weight of polyurethane.

9. A fabric according to claim 1 wherein the blended monofilament contains at least 30% by weight of polyurethane.

10. A fabric according to claim 1 wherein the blend contains from about 0.3% to about 5% stabilizer.

11. A fabric according to claim 1 wherein the blend contains from about 0.7% to about 3% stabilizer.

12. A fabric according to claim 1 wherein the blend does not contain stabilizer.

13. A forming fabric for use in a paper making machine wherein:

(a) the minor proportion of the monofilaments making up the face of the forming fabric onto which the cellulose fiber pulp slurry laid is polyethylene terephthalate polyester blended with a thermoplastic polyurethane;

(b) a major proportion of the monofilaments making up the machine side of the forming fabric is a blend of polyethylene terephthalate polyester with a thermoplastic polyurethane;

(c) the blend comprises from more than 60% to 90% by weight of polyethylene terephthalate polyester, and from less than 40% to 10% by weight of thermoplastic polyurethane; and (d) the blend contains from zero up to about 5% by weight of a hydrolysis stabilizer; and wherein:

(i) the polyester has an intrinsic viscosity of between 0.50 and 1.20 when measured in a solvent comprising a 60:40 parts by weight mixture of phenol and 1,1,2,2-tetrachloroethane at a temperature of 30° C.;

(ii) the polyurethane is either an ether-based or an ester-based thermoplastic polyurethane polymer; and (iii) the polyurethane has a Durometer Type A hardness of no more than about 95 or a Durometer Type D hardness of no more than about 75.

14. A forming fabric according to claim 13 wherein the major proportion of the monofilaments making up the face of the forming fabric onto which the cellulose fiber pulp slurry is laid is polyethylene terephthalate and the minor proportion is polyethylene terephthalate blended with a thermoplastic polyurethane, and wherein the minor proportion of the monofilaments making up the machine side of the forming fabric is polyethylene terephthalate, and the major proportion is a blend of polyethylene terephthalate with a thermoplastic polyurethane.

15. A forming fabric according to claim 13 wherein the major proportion of the monofilaments which are a blend of polyester and polyurethane are laid in the cross-machine direction of the fabric.

16. A forming fabric according to claim 15 wherein substantially all of the monofilaments which are a blend are laid in the cross-machine direction of the fabric.

17. A fabric according to claim 13 wherein the polyester intrinsic viscosity is in the range of from 0.95 to 1.20.

18. A fabric according to claim 13 wherein in the blended monofilament the polyurethane is an ester-based thermoplastic polyurethane polymer.

19. A fabric according to claim 13 wherein in the blended monofilament the polyurethane is an ether-based thermoplastic polyurethane polymer.

20. A fabric according to claim 13 wherein the blended monofilament contains at least 20% by weight of polyurethane.

21. A fabric according to claim 13 wherein the blended monofilament contains from about 25% to about 35% by weight of polyurethane.

22. A fabric according to claim 13 wherein the blended monofilament contains about 30% by weight of polyurethane.

23. A fabric according to claim 13 wherein the blend contains from about 0.3% to about 5% stabilizer.

24. A fabric according to claim 13 wherein the blend contains from about 0.7% to about 3% stabilizer.

25. A fabric according to claim 13 wherein the blend does not contain stabilizer.

26. In a papermaking machine forming fabric which is woven from a plurality of synthetic plastic yarns one set of which is intended to provide abrasion resistance to the fabric, the improvement comprising using as the yarn intended to provide abrasion resistance a monofilament consisting essentially of from more than 60% to 90% by weight of a high molecular weight polyethylene terephthalate polyester and from less than 40% to 10% by weight, of a thermoplastic polyurethane, together with from 0.3 to 5% of a hydrolysis stabilizer, wherein:

(i) the polyester has an intrinsic viscosity of between 0.50 and 1.20 when measured in a solvent comprising a 60:40 parts by weight mixture of phenol and 1,1,2,2-tetrachloroethane at a temperature of 30° C.;

(ii) the polyurethane is either an ether-based or an ester-based thermoplastic polyurethane polymer; and (iii) the polyurethane has a Durometer Type A hardness of no more than about 95 or a Durometer Type D hardness of no more than about 75.

27. In a papermaking machine forming fabric which is woven from a plurality of synthetic plastic yarns one set of which is intended to provide abrasion resistance to the fabric, the improvement comprising using as the yarn intended to provide abrasion resistance a monofilament consisting essentially of from more than 60% to 90% by weight of a high molecular weight polyethylene terephthalate polyester and from less than 40% to 10% by weight, of a thermoplastic polyurethane, wherein:

(i) the polyester has an intrinsic viscosity of between 0.50 and 1.20 when measured in a solvent comprising a 60:40 parts by weight mixture of phenol and 1,1,2,2-tetrachloroethane at a temperature of 30° C.;

(ii) the polyurethane is either an ether-based or an ester-based thermoplastic polyurethane polymer; and (iii) the polyurethane has a Durometer Type A hardness of no more than about 95 or a Durometer Type D hardness of no more than 75.

28. In a papermaking machine forming fabric which is woven from a plurality of synthetic plastic monofilaments one of which is intended to provide abrasion resistance to the fabric, the improvement comprising using as the monofilament intended to provide abrasion resistance a monofilament consisting essentially of from more than 60% to 90% by weight of a high molecular weight polyethylene terephthalate polyester and from less than 40% to 10% by weight, of a thermoplastic polyurethane, together with from 0.3 to 5% of a hydrolysis stabilizer, wherein:

(i) the polyester has an intrinsic viscosity of between 0.50 and 1.20 when measured in a solvent comprising a 60:40 parts by weight mixture of phenol and 1,1,2,2-tetrachloroethane at a temperature of 30° C.;

(ii) the polyurethane is either an ether-based or an ester-based thermoplastic polyurethane polymer; and (iii) the polyurethane has a Durometer Type A hardness of no more than about 95 or a Durometer Type D hardness of no more than about 75.

29. In a papermaking machine forming fabric which is woven from a plurality of synthetic plastic monofilaments one of which is intended to provide abrasion resistance to the fabric, the improvement comprising using as the monofilament intended to provide abrasion resistance a monofilament consisting essentially of from more than 60% to 90% by weight of a high molecular weight polyethylene terephthalate polyester and from less than 40% to 10% by weight, of a thermoplastic polyurethane, wherein:

(i) the polyester has an intrinsic viscosity of between 0.50 and 1.20 when measured in a solvent comprising a 60:40 parts by weight mixture of phenol and 1,1,2,2-tetrachloroethane at a temperature of 30° C.;

(ii) the polyurethane is either an ether-based or an ester-based thermoplastic polyurethane polymer; and (iii) the polyurethane has a Durometer Type A hardness of no more than about 95 or a Durometer Type D hardness of no more than about 75.

30. A forming fabric according to claim 1, for use in a paper making machine, wherein in the at least one set of yarns woven in a second direction of the fabric:

(a) the minor proportion of the monofilaments making up the face of the forming fabric onto which the cellulose fiber pulp slurry laid is polyethylene terephthalate polyester blended with a thermoplastic polyurethane;

(b) a major proportion of the monofilaments making up the machine side of the forming fabric is a blend of polyethylene terephthalate polyester with a thermoplastic polyurethane;

(c) the blend comprises from more than 60% to 90% by weight of polyethylene terephthalate polyester, and from less than 40% to 10% by weight of thermoplastic polyurethane; and (d) the blend contains from zero up to about 5% by weight of a hydrolysis stabilizer; and wherein:

(i) the polyester has an intrinsic viscosity of between 0.50 and 1.20 when measured in a solvent comprising a 60:40 parts by weight mixture of phenol and 1,1,2,2-tetrachloroethane at a temperature of 30° C.;

(ii) the polyurethane is either an ether-based or an ester-based thermoplastic polyurethane polymer; and (iii) the polyurethane has a Durometer Type A hardness of no more than about 95 or a Durometer Type D hardness of no more than about 75.

31. A forming fabric according to claim 30 wherein the major proportion of the monofilaments making up the face of the forming fabric onto which the cellulose fiber pulp slurry is laid is polyethylene terephthalate and the minor proportion is polyethylene terephthalate blended with a thermoplastic polyurethane, and wherein the minor proportion of the monofilaments making up the machine side of the forming fabric is polyethylene terephthalate, and the major proportion is a blend of polyethylene terephthalate with a thermoplastic polyurethane.

32. A forming fabric according to claim 30 wherein the major proportion of the monofilaments which are a blend of polyester and polyurethane are laid in the cross-machine direction of the fabric.

33. A forming fabric according to claim 32 wherein substantially all of the monofilaments which are a blend are laid in the cross-machine direction of the fabric.

34. A fabric according to claim 30 wherein the polyester intrinsic viscosity is in the range of from 0.95 to 1.20.

35. A fabric according to claim 30 wherein in the blended monofilament the polyurethane is an ester-based thermoplastic polyurethane polymer.

36. A fabric according to claim 30 wherein in the blended monofilament the polyurethane is an ether-based thermoplastic polyurethane polymer.

37. A fabric according to claim 30 wherein the blended monofilament contains at least 20% by weight of polyurethane.

38. A fabric according to claim 30 wherein the blended monofilament contains from about 25% to about 35% by weight of polyurethane.

39. A fabric according to claim 30 wherein the blended monofilament contains about 30% by weight of polyurethane.

40. A fabric according to claim 30 wherein the blend contains from about 0.3% to about 5% stabilizer.

41. A fabric according to claim 30 wherein the blend contains from about 0.7% to about 3% stabilizer.

42. A fabric according to claim 30 wherein the blend does not contain stabilizer.

* * * * *